US010253465B2

(12) United States Patent
Preston

(10) Patent No.: US 10,253,465 B2
(45) Date of Patent: Apr. 9, 2019

(54) MODULAR BUILDING CONSTRUCTION USING COMPOSITE INTERCONNECTED FRAME PANELS

(71) Applicant: John Preston, Glebe (AU)

(72) Inventor: John Preston, Glebe (AU)

( * ) Notice: Subject to any disclaimer, the term of this patent is extended or adjusted under 35 U.S.C. 154(b) by 0 days.

(21) Appl. No.: 15/637,418

(22) Filed: Jun. 29, 2017

(65) Prior Publication Data

US 2018/0142433 A1 May 24, 2018

Related U.S. Application Data

(63) Continuation of application No. 15/030,007, filed as application No. PCT/AU2014/000976 on Oct. 16, 2014, now abandoned.

(30) Foreign Application Priority Data

Oct. 16, 2013 (AU) ..... 2013903989

(51) Int. Cl.
*E04B 1/24* (2006.01)
*E01D 18/00* (2006.01)
(Continued)

(52) U.S. Cl.
CPC ..... *E01D 18/00* (2013.01); *E04B 1/34807* (2013.01); *E04B 2/00* (2013.01);
(Continued)

(58) Field of Classification Search
CPC ..... E04B 1/3483; E04B 1/34807; E04B 1/24; E04C 2/384; E04C 2/40; E04H 1/005; E04H 1/1205
See application file for complete search history.

(56) References Cited

U.S. PATENT DOCUMENTS 4,910,932 A * 3/1990 Honigman ..... E04B 1/08 52/280
5,402,608 A * 4/1995 Chu ..... E04B 1/3483 52/745.2

(Continued)

*Primary Examiner* — Brian D Mattei
*Assistant Examiner* — Daniel J Kenny
(74) *Attorney, Agent, or Firm* — Stephen J. Weyer, Esq.; Stites & Harbison, PLLC

(57) ABSTRACT

A building module for use in construction of a structure incorporating a plurality of said modules which together form at least part of the structure. Each building module comprises a first peripheral frame of a first size defining a space which receives a layer of barrier material, a second peripheral frame of a second size defining a space which receives a layer of barrier material and which is joined at a first junction to the first peripheral frame of the first size in abutting end to end relationship to form a first auxiliary module. A third peripheral frame has the same size as the first peripheral frame and which defines a space which receives a layer of barrier material. A fourth peripheral frame has the same size as the second peripheral frame and which defines a space which receives a layer of barrier material and which is joined at a second junction to the third peripheral frame of the first size in abutting end to end relationship to form a second auxiliary module. The first and second auxiliary modules are attached side by side to form said building module; wherein the first and second auxiliary modules are attached to each other so that the first and second junctions are staggered along the length of the structure.

17 Claims, 7 Drawing Sheets

(51) Int. Cl.

| | |
|---|---|
| ***E04F 11/035*** | (2006.01) |
| ***E04B 2/00*** | (2006.01) |
| ***E04C 2/00*** | (2006.01) |
| ***E04G 1/17*** | (2006.01) |
| ***E04G 21/32*** | (2006.01) |
| ***E04B 1/348*** | (2006.01) |

(52) U.S. Cl.
CPC ..... *E04C 2/00* (2013.01); *E04F 11/035* (2013.01); *E04G 1/17* (2013.01); *E04G 21/3204* (2013.01)

(56) References Cited

U.S. PATENT DOCUMENTS 6,463,705 B1 * 10/2002 Davis ..... E04B 1/343 52/143
7,231,742 B2 * 6/2007 Majlessi ..... E04B 1/24 52/167.3
8,276,328 B2 * 10/2012 Pepin ..... E04B 1/3483 52/167.3
8,356,446 B2 * 1/2013 Takeda ..... A47C 29/003 52/762
2004/0231256 A1 * 11/2004 Ohnishi ..... E04B 1/3483 52/236.7
2007/0271857 A1 * 11/2007 Heather ..... B65D 88/005 52/79.9
2009/0019811 A1 * 1/2009 Goldman ..... E04B 1/34807 52/653.2
2010/0000822 A1 * 1/2010 Wall ..... E04G 1/08 182/128
2012/0240482 A1 * 9/2012 Pitt ..... B66C 1/66 52/122.1
2013/0048430 A1 * 2/2013 Preston ..... E04G 1/17 182/178.1
2016/0319534 A1 * 11/2016 Bernardo ..... E04B 1/3483

* cited by examiner

MODULAR BUILDING CONSTRUCTION USING COMPOSITE INTERCONNECTED FRAME PANELS

CROSS REFERENCE TO RELATED APPLICATION

This is a continuation of U.S. patent application Ser. No. 15/030,007, filed on Apr. 15, 2016 as a national stage of PCT/AU2014/000976 filed on Oct. 16, 2014, both herein incorporated by reference.

BACKGROUND

The present invention relates to an alternative method of modular construction using modules for the construction of such structures as modular stairways and module walkways such as but not limited to those used on construction sites The present invention further relates to a modular structures which use frame modules which are either used in conjunction with other like frame modules or attached to a primary box frame. The invention further relates to constructions such as a modular walkway bridge assembled using a space frame superstructure and frame modules which co-operate to form at least walls and a floor of the walkway. The present invention has been primarily developed in order to produce a transportable modular system of space frames which reinforce a primary structure such as but not limited to a stairwell or walkway thereby increasing the strength of the walkway or stairway and increasing the speed of its construction and deconstruction. The invention further relates to a frame module which is capable of engagement with an abutting frame such that when a plurality of such frames are joined a modular wall is formed. Each modular frame has a plurality of connecting faces allowing the frames to be connected to an adjacent frame module via any one of the connecting faces. The invention further relates to a modular wall panel manufactured from a plurality of frames which when connected to like frames have staggered joint positions. The invention also provides space frame box sections of indefinite length, height and width, and which are reinforced by auxiliary frame modules.

PRIOR ART

Large building sites at which heavy construction takes place require walkways and stairwells for workers and other related personnel to navigate across a site elevated from the potentially unsafe building areas. Walkways and stairways provide protection for workers moving from one location to the other especially when ground conditions are hostile.

Typically a walkway would have a through passage with a required height 2-3 meters and a width of 1-2 meters. Gangway and walkways must have high bending, shear and torsional load resistance. Essentially they carry self weight and live loads—mainly personnel. Carrying self weight allows scope to increase span but as span increases, a greater load is placed on connections and load transmission points which transfer load back to primary supports. There are a variety of gangway types currently used in construction environments. One example comprises a truss space frame which is supported along its length on standard I beams sized according to the required span. The combination of the truss and supporting beams allows long spans which are often required to traverse relatively long distances on building sites.

Walkways are typically not bolted nor use separate modules but have been manufactured as a Universal Beam or Rolled Steel Joist or fabricated as a manufactured beam about double the size of a UB or RSJ. There is currently no very large beam component that can be assembled by bolting of sections and having the versatility of modularity such that modules can be added depending upon the length of the structure required.

These are strong beams capable of relatively long spans when the web is deep enough. A conventional truss or space frame which is made from a series of struts are arranged to transmit loads through the beam. Truss frames and beam combinations have a high strength to weight ratio. The current truss walkways have been effective for their purposes but there is always a need to further improve the versatility of walkway structures and to provide an alternative to the known methods and which is economic to manufacture, has a high strength to weight ratio and is versatile enough to enable the advantages of modularity and bolt together construction.

INVENTION

The present invention provides an alternative method of constructions of structural walkways, stairwells and other like modular constructions. According to one embodiment the invention provides a modular walkway bridge for use in such environments as building sites and the like and which is capable of assembly using modular space frames which co operate to form at least walls of the walkway. The present invention further provides transportable modular frames which reinforce a primary structure including a space frame thereby increasing the strength of the structure and increasing the speed of its construction and deconstruction. Although the invention will be described hereinafter with reference to its application in construction of building site walkways, it should be appreciated that the invention is not limited to this particular field of use or application. For example, the present invention is capable of use in footbridge, stairwell or viewing platform constructions in environments including but not limited to building sites. The invention according to one embodiment includes a modular frame which is capable of engagement with an abutting frame such that when a plurality of such frames are joined a modular structure is formed having staggered joints for reinforcing.

Each modular frame has a plurality of connecting faces allowing the module to be connected to an adjacent module via any one of the connecting faces. The invention further relates to a modular wall panel which is used in the assembly of a space frame walkway of indefinite length height and width, the walkway including a space frame which receives and is reinforced by the modular frames.

The present invention provides an alternative to the known prior art and the shortcomings identified. The foregoing and other objects and advantages will appear from the description to follow. In the description reference is made to the accompanying representations, which forms a part hereof, and in which is shown by way of illustration specific embodiments in which the invention may be practiced. These embodiments will be described in sufficient detail to enable those skilled in the art to practice the invention, and it is to be understood that other embodiments may be utilised and that structural changes may be made without departing from the scope of the invention. The following detailed description is, therefore, not to be taken as limiting the scope of the present invention.

In its broadest form the present invention comprises:
a building module for use in construction of a structure incorporating a plurality of said modules which together form at least part of the structure; each building module comprising;
a first peripheral frame of a first size defining a space which receives a layer of barrier material, a second peripheral frame of a second size defining a space which receives a layer of barrier material and which is joined at a first junction to the first peripheral frame of the first size in abutting end to end relationship to form a first auxiliary module;
a third peripheral frame having the same size as the first peripheral frame and which defines a space which receives a layer of barrier material, a fourth peripheral frame having the same size as the second peripheral frame and which defines a space which receives a layer of barrier material and which is joined at a second junction to the third peripheral frame of the first size in abutting end to end relationship to form a second auxiliary module; wherein the first and second auxiliary modules are attached side by side to form said building module; wherein the first and second auxiliary modules are attached to each other so that the first and second junctions are staggered along the length of the structure.

In another broad form the present invention comprises:
a frame module for use in the construction of a structure formed using a plurality of like modules, the module comprising a first peripheral frame of a first size defining a space which receives a layer of barrier material, a second peripheral frame of a second size defining a space which receives a layer of barrier material and which is joined at a first junction to the first peripheral frame of the first size in abutting end to end relationship; each said frames including separate bracing; the frame module comprising part of the structure.

In an alternative form the present invention comprises:
a walkway bridge including a mainframe having a base, top and sides; the mainframe constructed from primary modules each abutting a like primary module and forming a junction between the primary modules; the modules sized so that the junctions are equidistant;
at least two auxiliary modular frames engaging each side of the main frame and each frame comprising a top, a base and side members; wherein each auxiliary frame is connected to the main frame so that a junction between the auxiliary modular frames does not align with a junction between the primary modules.

According to a preferred embodiment, the junctions between the auxiliary modular frames are staggered in relation to the junctions formed by abutting frames. This arrangement reinforces the total bridge structure and places joins in the primary modules closer to the joins of the auxiliary frames and reinforces the sides of the primary modules. The walkway is a beam manufactured in the form of a frame with reinforced walls formed by frame modules bolted together.

In another broad form the present invention comprises:
a walkway constructed from a plurality of modular frames, a first type of said frames comprising a box section space frame having a top, bottom and sides; a second type of frame module comprising a frame having a top bottom and sides defining an internal space, and attachable to the first frame; wherein a plurality of the second frame type is connected to a plurality of the first frame type such that joins formed by connection of the first frame type and joins formed by connection of the second frame type are staggered along the length of the walkway. Preferably the box frame and second frame type (auxiliary frame) are manufactured from bolt together angle sections.

In another broad form the present invention comprises
a structural walkway of substantially rectangular cross-section manufactured from modules comprising bolt together angle sections; the walkway including a primary module type defining a box section space frame and an auxiliary module comprising a generally planar frame; wherein the walkway is constructed from a plurality of said primary frame modules and a plurality of said auxiliary frame modules; wherein the modules are arranged such that when the auxiliary modules are connected to the primary modules a join formed between primary modules is staggered relative to a location of joins formed by the auxiliary modules.

A method of construction of a walkway including a primary module type defining a box section space frame and an auxiliary module comprising a generally planar frame; the method comprising the steps of;
a) constructing a plurality of box section primary space frames and joining the space frames end to end such that an internal passage passes therealong;
b) constructing a plurality of auxiliary planar frames and attaching the frames to the primary frames;
c) arranging joins formed between the primary frames and joins between the auxiliary frames such that they are staggered along the length of the walkway so formed.

The examples referred to herein are illustrative and are not to be regarded as limiting the scope of the invention. While various embodiments of the invention will be described herein, it will be appreciated that these are capable of modification, and therefore the disclosures herein are not to be construed as limiting of the precise details set forth, but to avail such changes and alterations as fall within the purview of the description. It is an object of the present invention to substantially overcome or at least ameliorate one or more of the above prior art disadvantages. Accordingly, in a first aspect, the present invention provides a module for use in a walkway or stairwell structure made from one or a plurality of like modules allowing ease of assembly and disassembly. In attempting to ameliorate or eliminate the prior art limitations and to provide a useful alternative to the known structural walkways, the present invention seeks to provide a more efficient alternative which due to its modularity has the capability of reinforcing the composite structure as a result of staggered locations of module joins.

It is one object of the present invention to increase the efficiency of modular construction and to enable increased versatility in the use and modularity of walkways, stairwells and the like and improving strength depending upon the selection of inter engagements of one module with another.

The present invention provides an alternative to the known prior art and the shortcomings identified. The foregoing and other objects and advantages will appear from the description to follow. In the description reference is made to the accompanying representations, which forms a part hereof, and in which is shown by way of illustration specific embodiments in which the invention may be practiced. These embodiments will be described in sufficient detail to enable those skilled in the art to practice the invention, and it is to be understood that other embodiments may be utilised and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The present invention will now be described in more detail according to a preferred but non limiting embodiment and by way of example only with reference to the accompanying drawings wherein.

Preferred embodiments of the invention will now be described, in relation to the accompanying drawings in which.

DETAILED DESCRIPTION OF PREFERRED EMBODIMENTS

The examples referred to herein are illustrative and are not to be regarded as limiting the scope of the invention. While various embodiments of the invention have been described herein, it will be appreciated that these are capable of modification, and therefore the disclosures herein are not to be construed as limiting of the precise details set forth, but to avail such changes and alterations as fall within the purview of the description. Although the method and apparatus aspects of the invention will be described with reference to their application to heavy and light building construction, it will be appreciated that the invention has alternative applications.

Figure 1:
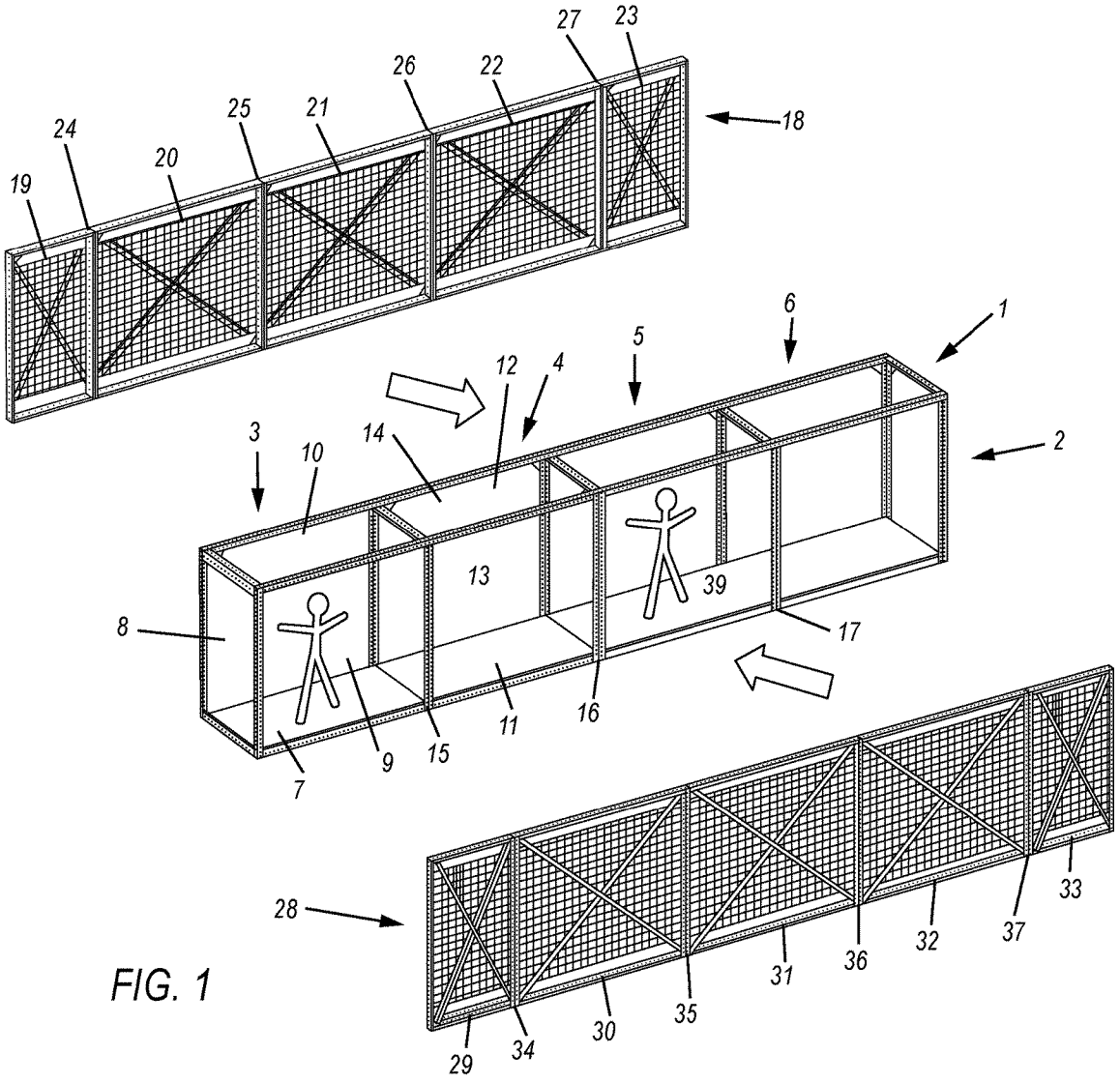
FIG. 1 shows a perspective exploded view of the walkway assembly according to a preferred embodiment.

Referring to FIG. 1 there is shown a perspective exploded view of a walkway assembly 1 according to a preferred embodiment. Assembly 1 comprises a primary frame 2 which includes primary box frame modules 3, 4, 5 and 6. Frame modules 3, 4, 5 and 6 are a series of box frames which are bolted together end to end to define an internal passage to become a walkway 39. Primary box frame 3 is formed as a series of rectangular cube space frames joined end to end and proportioned to accommodate personnel walking through the walkway assembly 1 along walkway 39. Module 3 comprises a bottom 7, sides 8 and 9 and a top 10. Module 4 likewise comprises a bottom 11, sides 12 and 13 and top 14. Modules 3 and 4 are arranged in abutting relationship and form join 15. Similarly module 5 joins module 4 to form join 16 and module 6 joins module 5 to form join 17. Joins 15, 16 and 17 are evenly spaced. Typically each box frame module is bolted to an adjacent module via abutting opposing module faces. Assembly 1 further comprises a wall 18 of secondary/auxiliary frame modules 19, 20, 21, 22 and 23. Auxiliary modules 19 and 20 form joint 24. Modules 20 and 21 form joint 25. Modules 21 and 22 form joint 26 and modules 22 and 23 form joint 27. Modules 19 and 23 are half modules and modules 20, 21 and 22 are full sized modules. Thus modules 19 and 23 define an area which is approximately half the area defined by frames 20, 21 and 22.

Assembly 1 further comprises a wall 28 of secondary/auxiliary frame modules 29, 30, 31, 32 and 33. Auxiliary modules 29 and 30 form joint 34. Modules 30 and 11 form joint 35. Modules 31 and 32 form joint 36 and modules 32 and 33 form joint 37. Modules 29 and 33 are half modules and modules 30, 31 and 32 are all full sized modules. The combination of frame 32 and half frame 33 allows versatility of construction in that the use of half modules allows joints 34, 35, 36 and 37 to be staggered relative to joints 15, 16 and 17 of box modules 3, 4, 5 and 6. Walls 18 and 28 in use engage box frame modules in frame 2 and allow staggering of the wall joints and main box frame joints to thereby impart additional strength compared to the strength of a structure using the same components if the joints were not staggered—for instance if the joint 35 was in alignment with joint 15.

Figure 2:
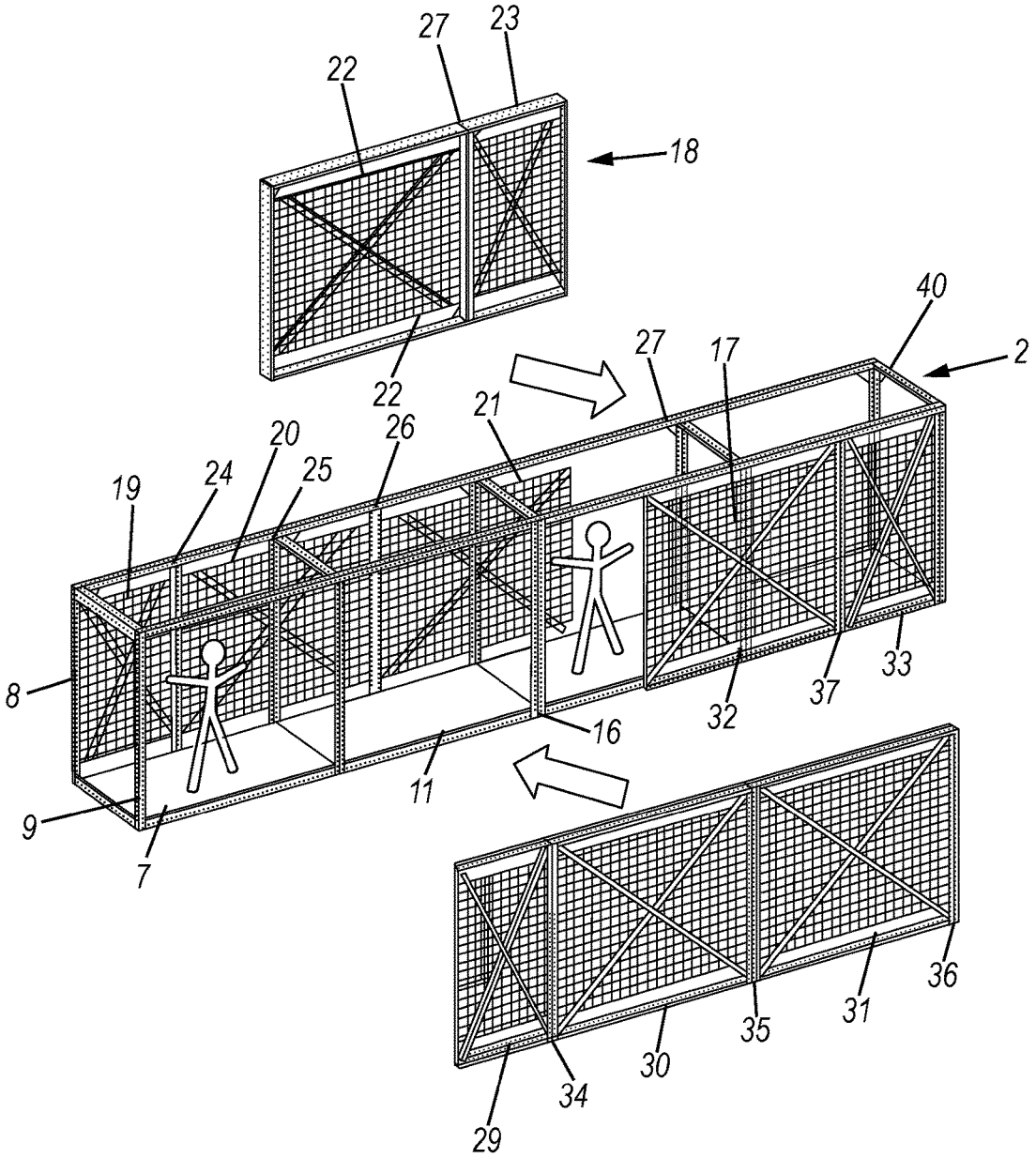
FIG. 2 shows a perspective view of the assembly of FIG. 1 partially constructed with auxiliary frames attached to the primary frame box sections.

FIG. 2 shows with corresponding numbering a perspective view of the assembly 1 of FIG. 1 partially constructed with auxiliary frames attached to opposing walls 18 and 28 of the primary frame. It can be seen from this partially completed walkway that the joints of the main frame 2 and the joints of auxiliary walls 18 and 28 are laterally out of alignment or in other words staggered along the length of the structure. The staggered alignment of the mainframe joints and panels is best shown with reference to join 17 of frame 2. Join 17 aligns about midway along frame 32. Joint 37 between frame members 32 and 33 locates midway between joint 17 and end 40 of frame 2. The staggering of joints 17 and 37 imparts a reinforcing effect on the structure including improved shear, torsional and bending strength.

Figures 3, 4, 5:
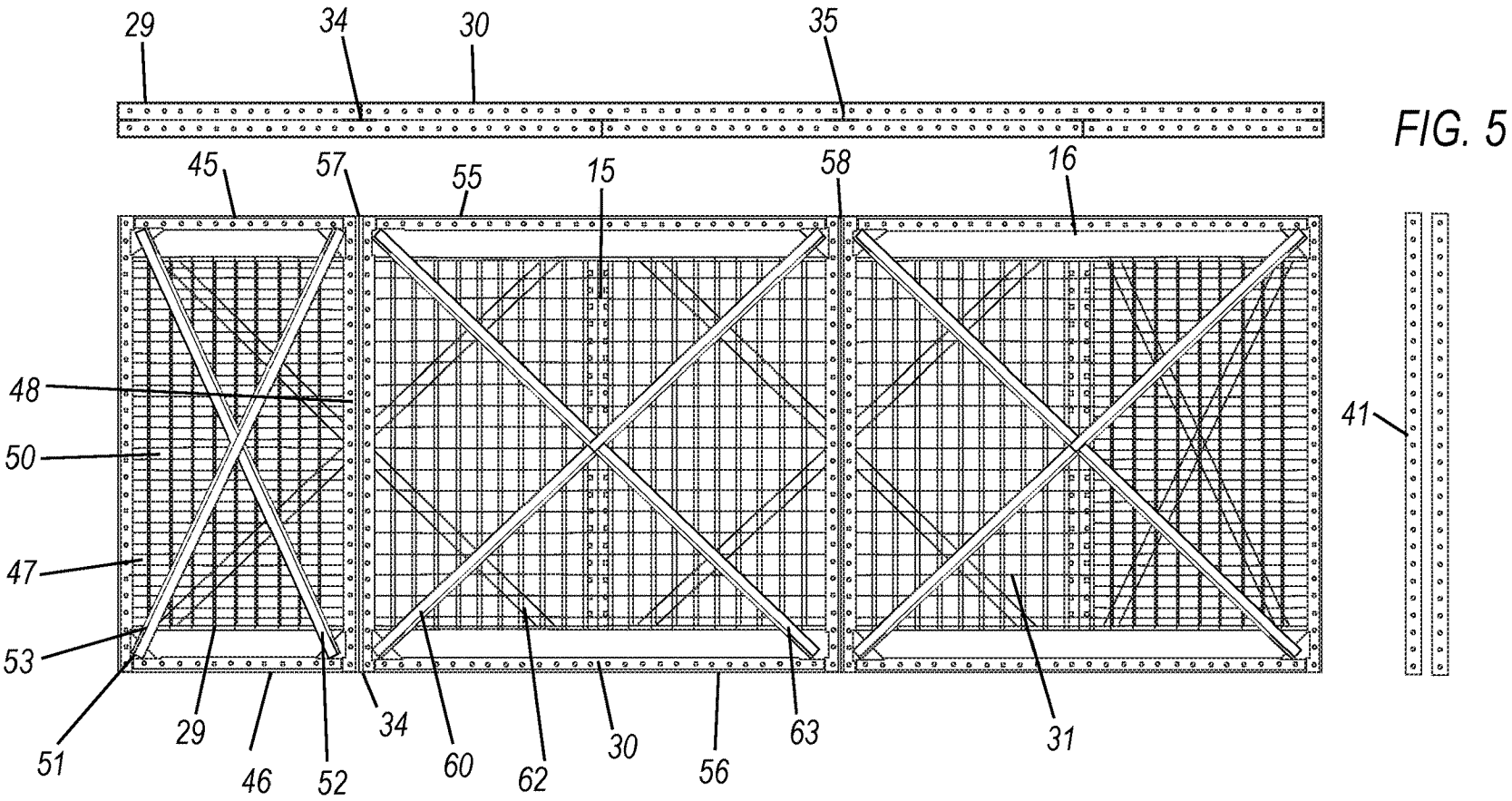
FIG. 3 shows an elevation view of auxiliary frames joined together and the relationship with joins of the primary frames.
FIG. 4 shows a top view of the auxiliary frames of FIG. 3.
FIG. 5 shows a side elevation view of the auxiliary frames of FIG. 4.

FIG. 3 shows an elevation view of auxiliary frames 29, 30 and 31 joined together and the relationship with joins 15 and 16 of the primary frames. Half frame 29 forms a join 34 with full frame 30. Full frame 30 forms a join 35 with full frame 31. It can be seen that joins 34, 15, 35 and 16 are staggered along the length of the frame modules. This provides reinforcing strength intermediate the primary frame module joins 15 and 16 and generally reinforces the composite structure along the length of the walkway so formed. This allows an increased span and high strength. Preferably, each frame member includes a plurality of bolt holes 41 which enable mutual connection of modules to each other and connection of modules to the primary frame. Half frame 29 is constructed preferably using angle iron. Frame 29 comprises top and bottom members 45 and 46 and side members 47 and 48 which define a rectangular space. Variations in the shape of each frame is feasible but square and rectangular shapes are preferred. Each frame members 45, 46, 47 and 48 are adapted with spaced apart bolt holes 53 along the length of each member allowing bolting on opposing faces of the members when frame 29 abuts another auxiliary module such as full frame 30 and the primary box frame 2. Module 29 also includes a weld mesh inlay 50 which provides a protective cover for users of the walkway. Diagonal bracing members 51 and 52 which are preferably external, are provided to brace frame module 29.

Similarly full frame 30 comprises top and bottom members 55 and 56 and side members 57 and 58 which define a square space. Each frame member 55, 56, 57 and 58 are adapted with spaced apart bolt holes 60 along the length of each member allowing bolting on opposing faces of the members when frame 30 abuts auxiliary modules 29 and 31 the primary frame. Module 30 also includes a weld mesh inlay 61 which provides a protective cover for users of the walkway. Diagonal bracing members 62 and 63 are provided to brace frame module 30. Fame module 31 is constructed in a similar manner to that described for module 31.

Figure 6:
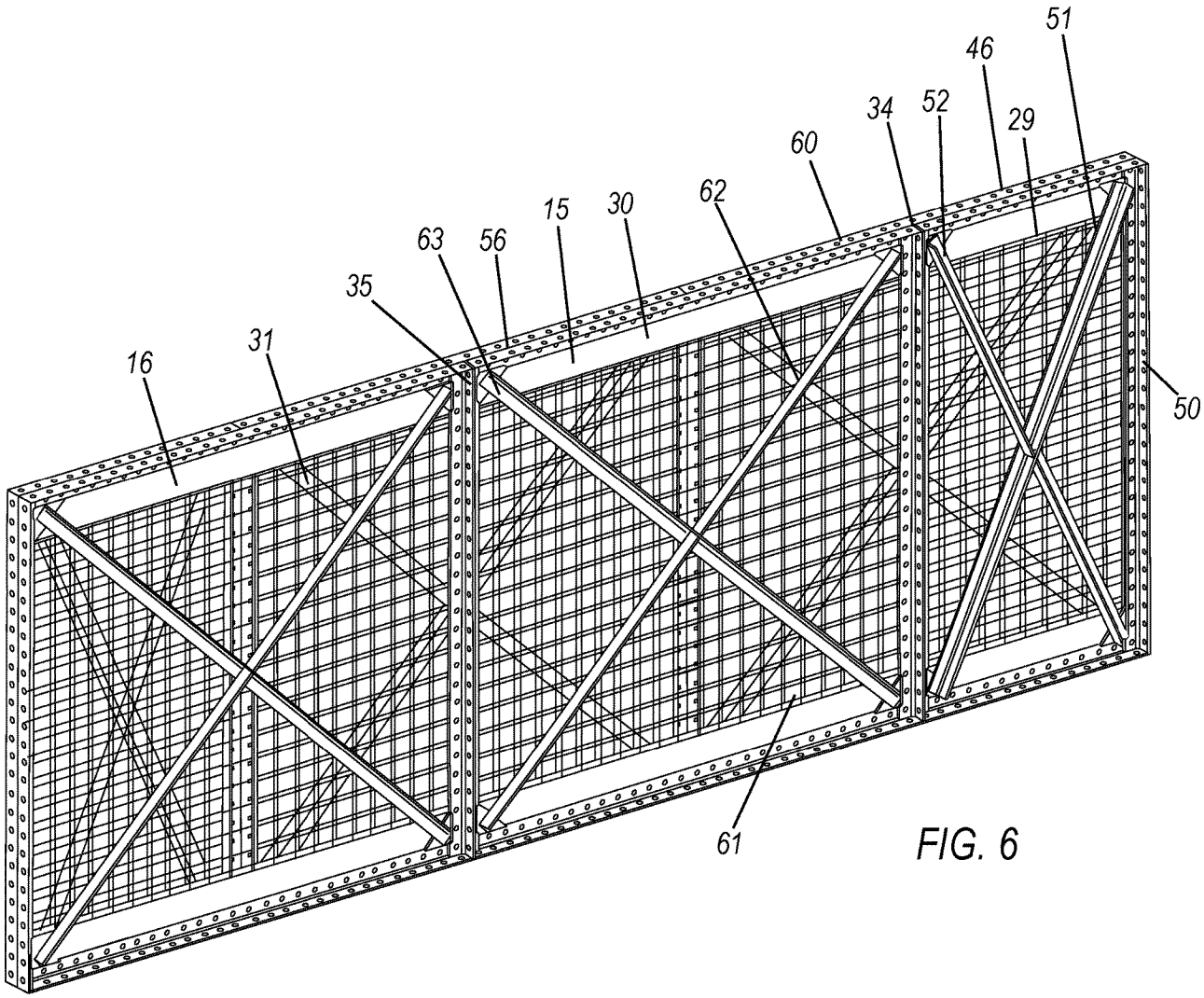
FIG. 6 shows a perspective view of the typical auxiliary frames of FIG. 3 interconnected.

FIG. 4 shows with corresponding numbering a top view of the auxiliary and primary frames of FIG. 3. FIG. 5 shows with corresponding numbering a side elevation view of the auxiliary frame module 31 and primary frame 2. FIG. 6 shows with corresponding numbering an opposite perspective view (to that shown in FIG. 3) of auxiliary frame modules 29, 30 and 31 of FIG. 4 joined together.

Figure 7:
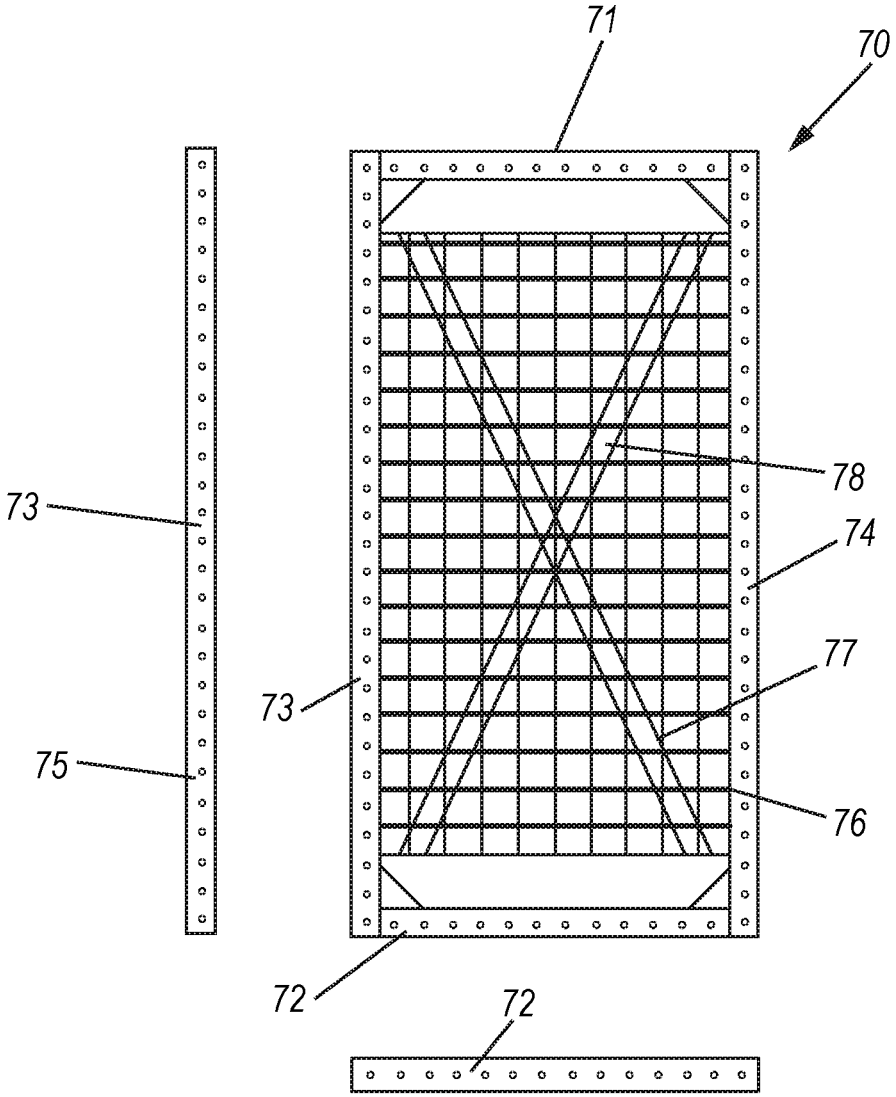
FIG. 7 shows an enlarged elevation view of a half size auxiliary frame module in isolation.

FIG. 7 shows an enlarged elevation view of a half size auxiliary frame module 70 in isolation. Half frame 70 is constructed preferably using angle iron. Frame 70 comprises top and bottom members 71 and 72 and side members 73 and 74 which define a rectangular space. Each frame member 71, 72, 73 and 74 are adapted with spaced apart bolt holes 75 along the length of each member allowing bolting on opposing faces of the members when frame 70 abuts another auxiliary module and the primary frame. Module 70 also includes a weld mesh inlay 76 which provides a protective cover for users of the walkway. Diagonal bracing members 77 and 78 which are preferably external, are provided to brace frame module 70.

Figure 8:
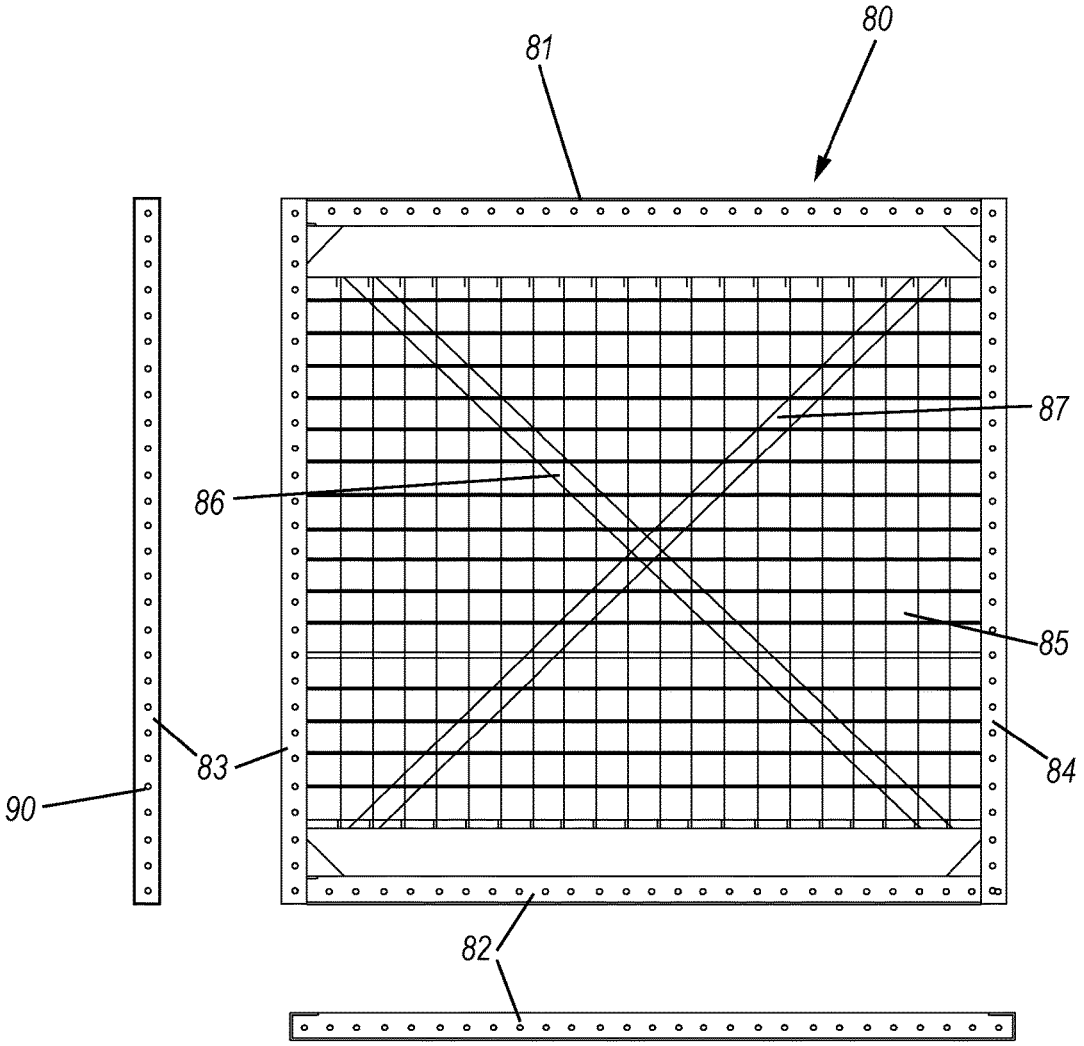
FIG. 8 shows an enlarged elevation view of a full size auxiliary frame module in isolation.
Figure 9:
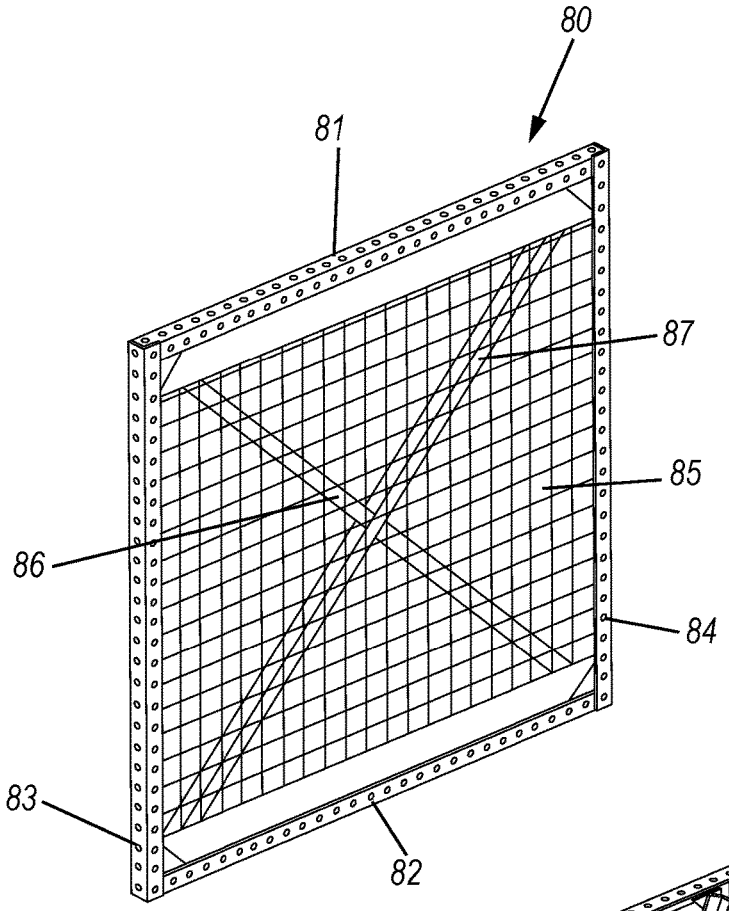
FIG. 9 shows an enlarged perspective view of a half size auxiliary frame module in isolation.
Figure 10:
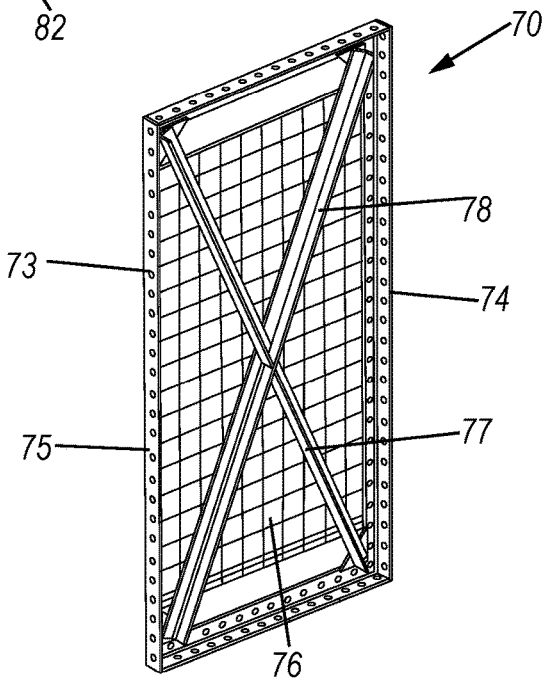
FIG. 10 shows an enlarged perspective view of a full size auxiliary frame module in isolation.

FIG. 8 shows an enlarged elevation view of a full size auxiliary frame module 80 in isolation. Similarly full frame 80 comprises top and bottom members 81 and 82 and side members 83 and 84 which define a square space. Each frame member 81, 82, 83 and 84 are adapted with spaced apart bolt holes 90 along the length of each member allowing bolting on opposing faces of the members when frame 80 abuts an auxiliary modules the primary box frame. Module 80 also includes a weld mesh inlay 85 which provides a protective cover for users of the walkway. Diagonal bracing members 86 and 87 are provided to brace frame module 80. FIG. 9 shows an enlarged perspective view of the full size auxiliary frame module 80 of FIG. 8 in isolation. FIG. 10 shows an enlarged perspective view of the half size auxiliary frame module 70 in isolation.

According to one embodiment the auxiliary frames can be connected back to back to increase module strength. In this embodiment a first frame is connected to a second frame in axial alignment to form a first auxiliary frame. A third frame is connected to a fourth frame which forms a second auxiliary frame. The first and second auxiliary frames are connected so that the joint between the first and second frame is staggered relative to the joint formed between the third and fourth frames. As the second frame is about half the area of the first frame and the fourth frame is about half the area of the third frame. This improves the strength of the composite frame and also improves the strength when the composite is connected to a primary box frame such as one half frame is connected to a full frame. In one embodiment, the junction of a half module and full module is opposed by a full module such that the join locates at a mid point of the opposing full module. Each auxiliary module join is therefore staggered.

When used with a box space frame, the box frame is prefabricated according to selected lengths required. This may be dictated by site or transport considerations. The bolted together box frames are preferably for use in long span applications creating effectively a box beam. A perimeter frame beam is made of flat steel sections preferably angles with multiple holes in each angle or frame so that each end faces have 18 mm holes at preferably 80 mm centres for a 16 mm bolts so that each face when bolted to another face or frame beam is staggered to form a superior larger beam. Preferably the measurements for the box frame beam are 2240 mm×2160 mm square with a half frame beam of 1120 mm×2160 mm. This allows staggering of the beams relative to the joints positions. This results in each joint being reinforced by another member bolted adjacent but staggered, so the opposite joints are not in lateral alignment. Preferably two flat faces of the frame beam are bolted together to stagger the joint and form a larger stronger frame. Bolt openings are placed every 80 mm to connect the adjacent frame on any face with holes at any location preferably half way. The invention also incorporates a two way brace so the beam can be rotated, so one of the braces is always in tension.

The Auxiliary frame half size module 70 (FIG. 10) and full size module 80 (FIG. 9) co operate to enable various configurations of walkway bridge construction depending upon particular site and builder's requirements. According to one embodiment box frame modules are sandwiched between an outer single layer of auxiliary frames on either side. At least one half auxiliary frame module is used to ensure that auxiliary frame joins and box frame joins are staggered on both sides of the box frames. This places joins of the box frames and auxiliary frames closer together and contributes to increased strength of the overall bridge structure in bending, torsion and shear. According to another embodiment, box frame modules are sandwiched between an outer single layer of auxiliary frames on one side and a double layer of staggered join auxiliary frames on an opposite side. In a further embodiment, box frame modules are sandwiched between two layers of back to back auxiliary panels either side of the box frames to firm a double strength truss like structure. FIGS. 3, 4, 5 and 6 show the two layered panels fixed back to back. In a further embodiment, a bridge structure is constructed using two panels as side panels and a decking with no roof. Thus it can be seen that the auxiliary full and half panels can be arranged in a variety of configurations to increase the strength of a walkway bridge formed from a structure of box frames or open channel frames having no roof.

The walkway composite beam assembly is able to span long distances have improved torsional rigidity compared to the known beams of a corresponding size. They can be produced off site or on site by with low labour costs, lower plant costs and reduced manual handling. The beams can be produced from a variety of materials, including aluminium, steel, pre coated metal products which require no further surface finishing. Although the invention has been described with reference to specific examples, it would be appreciated by those skilled in the art that the invention may be embodied in many other forms.

Preferably, the plates used to construct the beam are equal angle sections, although beams constructed from unequal angles are feasible. The angle sections are arranged so that beam width is dictated by the length of one of the legs of the angle sections. The top and bottom plates sizes can be of any practical length and depth according to particular structural requirement of the beam including those dictated by span and loads. Bolted connectors are preferred, with the bolt numbers dependent upon shear and other loadings to be resisted. Bracing of each module can be introduced as required. The modules beams can also be assembled from a kit to form frame modules which can then be connected to the primary beam assembled from a kit then joined to the primary box frames as required.

The present invention provides a useful alternative to the known walkways and provides additional choice for customers. Although the method and apparatus aspects of the invention have been described with reference to their application to walkways and gantries used on construction sites, it will be appreciated that the invention has alternative applications.

The beam modules described herein are preferably manufactured from steel but other materials may be employed such as heavy duty plastics materials and aluminium. One advantage of the invention described herein is that the staggered connecting joint methodology imparts high strength with shear bolts which also provide high resistance to shear bending and torsion. Although the drawings show bolt holes according to a particular size, it will be appreciated that a variety of bolt sizes (length and diameters) and bolt configurations can be employed depending upon frame member sizes and design loading requirements.

It should be understood that various changes and modifications to the presently preferred embodiments described herein will be apparent to those skilled in the art. Such changes and modifications can be made without departing from the spirit and scope of the present subject matter and without diminishing its intended advantages. For example the frame sizes can be altered according to requirements as with bolt sizes and member sizes. Also frame shapes can be altered as required. It is therefore intended that such changes and modifications be covered by the appended claims.

The claims defining the invention are as follows:

1. A structure for acting as a walkway or stairwell comprising at least a primary frame formed from at least two box frame modules and a plurality of building modules which together form at least part of the structure, each building module comprising:

a first peripheral frame of a first area size defining a space which includes a layer of barrier material, a second peripheral frame of a different area size defining a space which includes a layer of barrier material and which is joined at a first junction to the first peripheral frame of the first size in abutting end to end relationship to form a first auxiliary module, a third peripheral frame having the same size as the first peripheral frame and which defines a space which includes a layer of barrier material, and a fourth peripheral frame having the same size as the second peripheral frame and which defines a space which includes a layer of barrier material and which is joined at a second junction to the third peripheral frame of the first area size in abutting end to end relationship to form a second auxiliary module, wherein the first and second auxiliary modules are arranged in opposing relationship to form said building module, wherein the building modules are attached to the primary frame of the structure and wherein the first and second junctions of respective first and second auxiliary modules are staggered along the length of structure relative to an end to end join between two said box frame modules.

2. The structure according to claim 1 wherein the peripheral frames are formed from angle sections.

3. The structure according to claim 2 wherein the frame of the second area size is approximately half the area size of the first frame.

4. The structure according to claim 3 wherein the third frame is approximately twice the area size of the fourth frame.

5. The structure according to claim 4 wherein each said first, second, third and fourth frames include diagonally disposed cross bracing.

6. The structure according to claim 5 wherein the first and second auxiliary modules are joined via opposing said angle sections.

7. The structure according to claim 6 wherein the first and second auxiliary modules are connected, and the first junction of the first auxiliary module opposes the third frame.

8. The structure according to claim 7 wherein the second junction of the third and fourth frames opposes the first frame.

9. The structure according to claim 8 wherein the first junction of the first auxiliary module is staggered relative to the second junction of the second auxiliary module.

10. The structure according to claim 9 wherein the first and third frames are square and the second and fourth frames are rectangular, wherein the first and second junctions are disposed vertically, and wherein the plurality of primary modules form at least a side wall of a structure.

11. The structure according to claim 10 wherein the barrier material is steel mesh.

12. The walkway bridge according to claim 11 wherein each said angle sections include along their length, openings to receive fasteners.

13. The walkway bridge according to claim 12 wherein the frames and bracing are manufactured from steel.

14. The walkway bridge according to claim 13 wherein the frames are joined by transversely disposed connecting struts.

15. The walkway bridge according to claim 14 wherein each strut engages a joint of frame panels on one wall and provide lateral stability.

16. The structure according to claim 15 wherein the walkway constructed using a plurality of said primary frames, includes a plurality of box sections joined end to end and each having a top, bottom and sides, defining an internal space.

17. The structure according to claim 11 wherein the structure formed using said plurality of said building modules is an overhead pedestrian walkway.

* * * * *